United States Patent [19]

Kotsuka et al.

[11] 4,051,795

[45] Oct. 4, 1977

[54] CLOTH GUIDE MECHANISM IN A SEWING MACHINE

[75] Inventors: Tadashi Kotsuka, Hino; Torao Ohchi, Chofu, both of Japan

[73] Assignee: Tokyo Juki Kogyo Kabushiki Kaisha, Tokyo, Japan

[21] Appl. No.: 762,231

[22] Filed: Sept. 16, 1968

[30] Foreign Application Priority Data

Sept. 23, 1967 Japan ..... 42-61139

[51] Int. Cl.[2] ..... D05B 35/10

[52] U.S. Cl. ..... 112/153

[58] Field of Search ..... 112/153, 152, 136, 137, 112/138, 141, 143, 147

[56] References Cited

U.S. PATENT DOCUMENTS

| | | | |
|---|---|---|---|
| 1,191,707 | 7/1916 | Kimmel | 112/137 |
| 1,748,770 | 2/1930 | Horning | 112/152 |
| 3,154,033 | 10/1964 | Roy | 112/152 |

*Primary Examiner*—H. Hampton Hunter
*Attorney, Agent, or Firm*—Wenderoth, Lind & Ponack

[57] ABSTRACT

A cloth guide mechanism in a sewing machine includes a member disposed at an angle with respect to a line normal to the pulling direction of cloth and provided with a slanted portion, a guide for receiving the cloth and having passages through which the cloth passes while being flexed, an adjustable cloth positioning element having a first positioning portion disposed at an angle with respect to the cloth pulling direction and a second portion disposed in parallel to the cloth pulling direction for maintaining the distance of a seam line to be formed in the cloth from one side edge of the cloth at a constant value, and an arrangement for imparting a tension on the cloth sufficient to reduce the force which urges the side edge against the first and second portions of the positioning means as the cloth is moved along the slanted portion of the first-mentioned means and to permit the cloth to move in the pulling direction.

8 Claims, 4 Drawing Figures

CLOTH GUIDE MECHANISM IN A SEWING MACHINE

BACKGROUND OF THE INVENTION

One type of conventional cloth guide mechanism for use in sewing machines comprises guide means disposed at an angle to a line intersecting the direction in which a piece of cloth to be sewn is pulled and adapted to fold the cloth at one side edge thereof, the guide means being provided with a slanted portion; and control means for controlling the movement of the cloth as the same moves along the slanted portion of the guide means so as to maintain the distance of a seam line to be formed in the cloth from the folded side edge at a constant value. However, in such a prior art cloth guide mechanism the cloth is forced to move along the slanted portion of the guide means and the folded side edge of the cloth is strongly urged against the control means. Furthermore, when the cloth has a lappet of a constant width formed by being folded at one side edge of the cloth, the lappet does not directly contact the guide means as the cloth moves around the slanted portion of the guide means, but only the remaining wider portion of the cloth directly contacts the periphery of the guide means. This causes a frictional resistance, and therefore, the area of the cloth portion which contacts the slanted portion of the guide means as the cloth is pulled is larger than that of the lappet having the constant width and as a result, the lappet which should have a predetermined constant width is strongly urged against the control means and a larger percent of the remaining wider portion of the cloth is caused to be displaced toward and strongly abutted against the control means, whereby the folded side edge will become out of shape resulting in a variation in the distance of the seam line in the cloth from the folded side edge. Such variation in the seam line distance will produce an inferior quality cloth product having a meandering seam line therein. And the folded side edge of the cloth will become out-of-shape as the cloth is pulled while being strongly urged against the control means, and if the cloth having the out-of-shape edge fold is continuously pulled along the guide means the out-of-shape edge fold may overlap over another portion of the cloth which may underlie the lappet to increase the thickness at the area where the seam line is to be formed to the extent that the thickened cloth portion clogs the guide means, thereby makeing it impossible to pull the cloth through the guide means and resulting in obstruction of the formation of any seam line in the cloth.

SUMMARY OF THE INVENTION

The present invention relates to a cloth guide mechanism in a sewing machine and more particularly, to a cloth guide mechanism suitably employed in a sewing machine of the type in which a piece of cloth is fed by being pulled at a point upstream of the sewing area on the sewing machine in the path of the cloth.

One object of the present invention is to provide a cloth guide mechanism in a sewing machine of the type described above in which a piece of cloth to be sewn is guided downwardly along guide means disposed at an angle intersecting the direction in which the cloth is guided or pulled to the sewing area on the sewing machine in such a manner that the distance of a seam line to be formed in the cloth from tne fold at one side edge of the cloth will always be maintained at a constant value and the cloth will pass through the sewing area while maintaining the constant seam line distance.

Another object of the present invention is to provide a cloth guide mechanism in a sewing machine which can effectively eliminate the above-mentioned disadvantages inherent in the prior art cloth guide mechanisms.

According to the present invention, there is provided a cloth guide mechanism, in a sewing machine, said mechanism comprising including means disposed at an angle with respect to a line normal to the direction in which a piece of cloth to be sewn is pulled or guided and having a slanted face of advancing the cloth in the pulling direction; guide means disposed at an angle with respect to the line normal to the pulling direction for passing the cloth therethrough to the sewing area of the sewing machine while flexing the cloth; adjustable cloth positioning means for guiding one side edge of the cloth to the sewing area so as to maintain a seam line to be formed in the cloth at a constant distance from such one side edge; and means for reducing the force which urges the one edge against the positioning means as the cloth passes along the slanted face and imparting tension to the cloth just sufficient to allow the cloth to move in contact with with slanted face while resisting the force urging the one side edge away from the positioning means.

The above and other objects and advantages of the present invention will be more readily apparent to those skilled in the art from a reading of the following description referring to the accompanying drawings.

PREFERRED EMBODIMENT OF THE INVENTION

Figure 1:
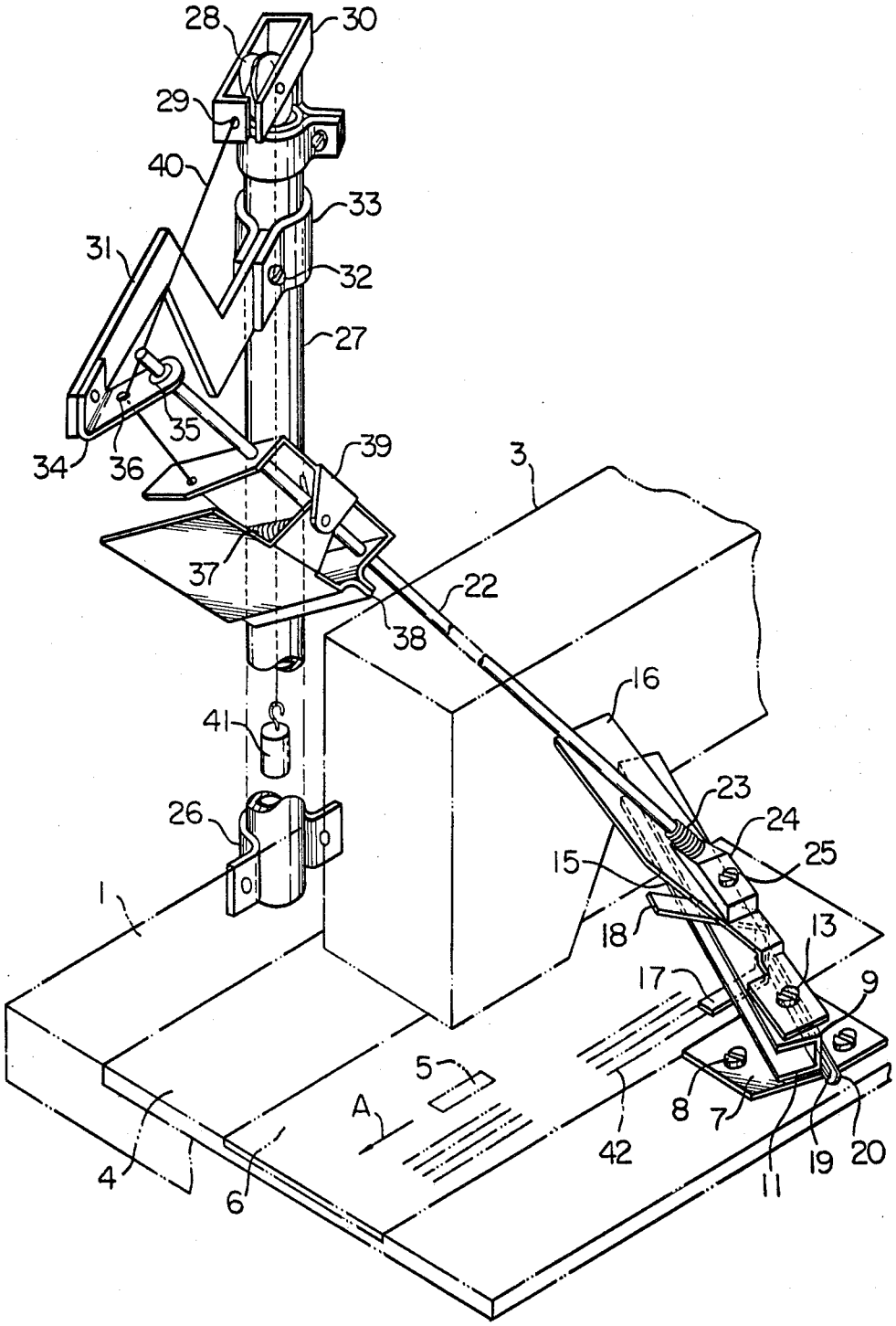
FIG. 1 is a perspective view of a preferred form of cloth gride mechanism in a sewing machine according to the present invention showing the mechanism as being mouted on the sewing machine only associated parts of which are shown therein.
Figure 2:
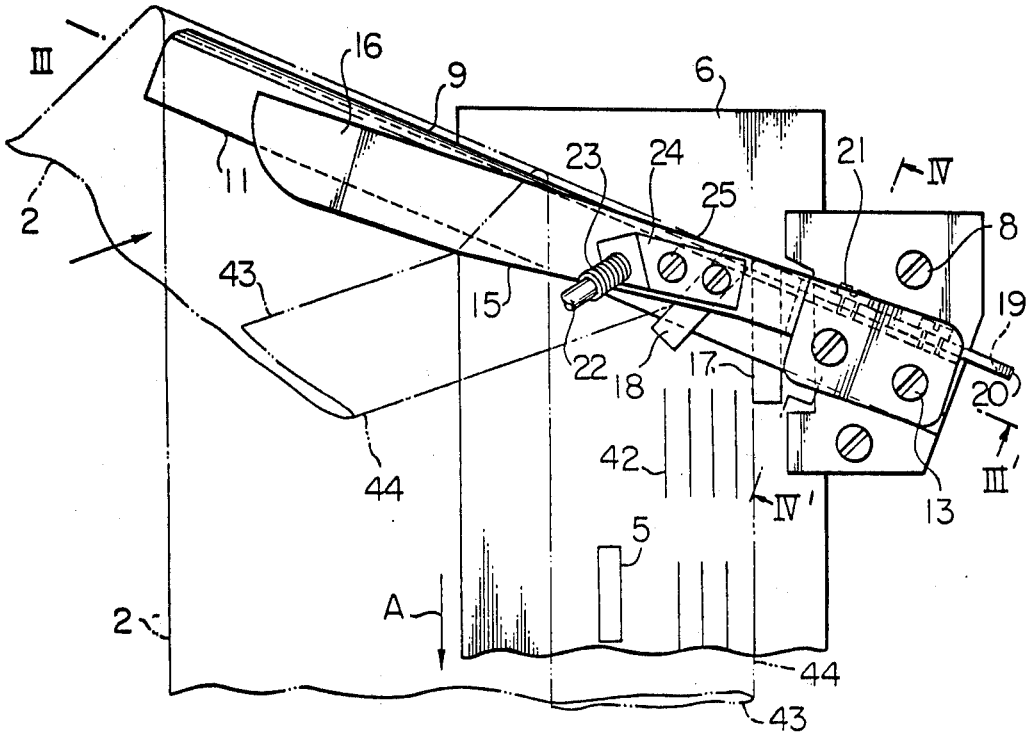
FIG. 2 is a fragmentary plan view of the cloth guide mechanism of FIG. 1.
Figure 3:
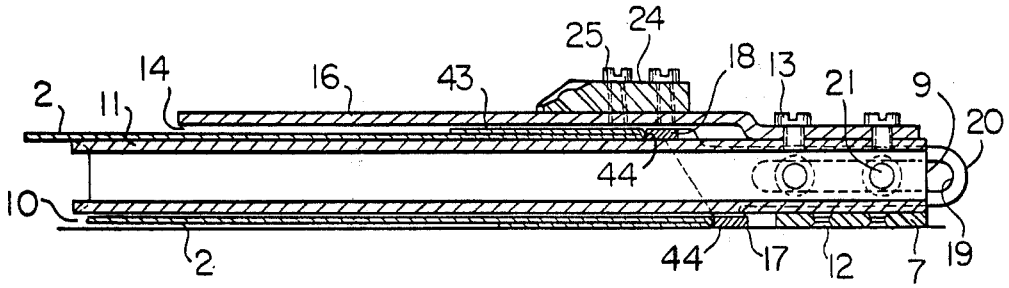
FIG. 3 is a section view taken substantially along the line III — III of FIG. 2 and as shown in the direction of the arrows thereof.

The present invention will now be described in detail referring the accompanying drawings in which a preferred form of cloth mechanism according to the present invention is shown together with associated parts of a sewing machine into which the novel guide mechanism is to be incorporated. The sewing machine which is generally indicated with reference numeral 3 comprises a table 1, a bed 4 which is fit in the upper side of the table 1 and held in position thereby. A needle plate 6 fits the upper side of the bed 4 and is held in position thereby and has a sewing area 5 in which a needle (not shown) is adapted to move reciprocally to effect a sewing operation on a piece of cloth 2 which is pulled in the direction or arrow A on the needle plate 6. Since the construction of the above-mentioned sewing machine itself is conventional and does not constitute part of the present invention, further description of the sewing machine itself will be not necessary and the machine will be further described only with reference to those parts which are associated with the guide mechanism of the present invention. According to the present invention, a mounting plate 7 of the cloth guide mechanism is fixedly mounted on the upper side of the bed 4 adjacent to one side edge or the inner side edge of the bed by means of set screws 8 and a first guide member 11 having a channel-shape a cross-section is fixedly mounted on the mounting plate 7 by means of rivets 12. The guide member 11 is disposed across the bed 4 and needle plate 6 in such an inclined position that the intermediate web 9 of the channel-shaped configuration may be disposed at an angle of about 20° with respect to a line normal to the cloth pulling direction A and may provide a clearance 10 between the lower side of the guide member 11 and needle plate 6 (see FIG. 3) the purpose of which clearance will be described hereinbelow. As shown in FIGS. 1, 2 and 3, a second guide plate 16 having a downward bent portion formed at one end thereof adjacent to the plate 7, is fixedly mounted at the bent end portion on the upper side of the upper flange portion of the first guide member 11 by means of a set screw 13 so as to provide a clearance 14 between the upper side of the first guide member 11 and the lower side of the raised portion of the second guide member 16 the purpose of which clearance will be described hereinbelow. The second guide member 16 is provided with a slanted portion 15 on the side edge facing to the sewing area 5. An adjustable cloth positioning means 20 having an elongated slot 19 adjacent to one end or the inner end is secured to the back of the first guide member intermediate web 9 by means of adjusting screws 21 which extend through the slot 19, and the positioning means is further provided with a pair of integral lower and upper legs or guide pieces 17 and 18 at the other end. The lower guide piece 17 passes through the lower clearance 10 and extends beyond the adjacent side edge of the lower flange of the first guide member 11 toward the sewing area 5 while the upper guide member 18 passes through the upper clearance 14 and extends beyond the adjacent side edge of the upper flange of the first guide member 11. The lower guide piece 17 extends in parallel to the cloth pulling direction A while the upper guide piece 18 extends at substantially 45° with respect to the cloth pulling direction A. As it will be easily understood, the position of the cloth positioning means 20 and more particularly, that of the lower and upper guide pieces 17 and 18 relative to the sewing area 5 may be easily adjusted by loosening the screws 21, and then moving the elongated main body of the positioning means 20 with respect to the first guide member intermediate web 9 along the back of the latter. After the adjustment, the screws 21 are again tightened so as to set the positioning means 20 in the adjusted position. The purpose of the cloth positioning means 20 will be made more clear hereinbelow. A sloping guide rod 22 is articularly connected at the lower end thereof to the upper side of the second guide member 16 substantially at the midpoint of the length of the latter by means of a flexible coil spring 23 which receives within the volutes at the free end thereof the lower end of the rod 22. As seen in FIG. 1, the guide rod 22 extends across the table 1, bed 4 and needle plate 6 over the head of the sewing machine. The spring 23 is in turn attached at the other end thereof to a support member 24 which is in turn secured to the upper side of the second guide member 16 by means of a set screw 25. As shown in FIG. 1, a tubular vertical pillar member 27 is fixedly mounted at the lower end thereof by means of a mounting bracket 26 on the upper side of the table 1 and the upper end of the pillar member rotatably supports a pulley 28 which is supported by a rectangular box-shaped member 30 which is open at the top and bottom. The rectangular box-shaped member 30 has a string guide bore 29 in one end wall thereof and a support bracket 33 is mounted on the pillar member 27 at a point below and slightly spaced from the box-shaped member 30. The bracket 33 has a substantially circular body portion provided with opposite and spaced parallel leg portions horizontally extending from the circular body portion. A support arm 31 is adjustably attached at one end thereof to the leg portions of the bracket 33 and the arm end is inserted between and held in position by the opposite leg portions of the bracket 33 by means of an adjusting screw 32 which extends through aligned bores in the bracket leg portions and inserted end of the support arm 31. Thus, it will be understood that the position of the support arm 31 may be adjusted vertically and laterally with respect to the support pillar member 27 by manipulating the screw 32 in the known manner. The other end of the support arm 31 has a V-shaped cross-section mounting member 34 fixedly attached thereto by a suitable ways and adjacent to the free end of the mounting member 34 there is formed a bore 35 through which the upper end of the guide rod 22 extends. The mounting member 34 also has formed therein a string guide bore 36 inwardly of and spaced from the bore 35 for guiding a length of string 40 therethrough. A slidable cloth pinching means 39 is supported on the guide rod 22 at a point below and spaced from the mounting member 34. The pinching means includes a pair of pinching members which are interconnected to each other at opposite side edges thereof by brackets which extend inwardly toward each other at substantially right angles with respect to the bodies of the pinching members and which partially overlap each other. A connecting pivot pin extends through aligned bores in the overlapping portions of the pinching member brackets, and a coiled spring 37 is disposed on the connecting pin with one end abutting against the inner side of one pinching at a point nearer to the upper end than to the lower end thereof. The other end of the spring abuts against the inner side of the other pinching member at a point nearer to the upper end than to the lower end thereof of the associated pinching. Thus, the upper end portions of the pair of pinching members 39 are normally urged outwardly while the lower end portions of the pinching members, the extreme ends of which terminate in lips, are caused to closely contact each other so as to provide a nip 38. In order to open the nip 38, the pair of pinching members 39 are manually gripped by the upper end portions thereof from the outside, and the member upper end portions are squeezed toward other against the force of the spring 37 so as to cause the pinching members to pivot about the pivot pin to the open position. The upper pinching member is formed in its upper end wall with a bore in which the leading end of the string 40 is secured in any suitable manner (not shown), and the upper end wall of the upper pinching members is also provided with a second bore spaced from the string anchoring bore through which second bore the rod 22 loosely extends. The lower end wall of the upper member is also provided with an aligned bore through which the rod also loosely extends. The string 40 extends from the upper pinching member 39 through the bore 36 in the mounting member 34, the bore 29 in the box-shaped support member 30 and over the peripheral groove of the pulley 28 downwardly into the hollow pillar member 27. The free end of the string 40 within the pillar member 27 has a ring which receives a hook extending from the top of a weight 41 which just sufficiently heavy to normally maintain the pair of pinching members 39 positioned an upper portion of the guide rod 22. On the upper side of the needle plate 6 there are provided a plurality of parallel and spaced cloth edge positioning or graduation lines 42 inwardly spaced from the sewing area 5 and extending in parallel to the cloth pulling direction A. By loosening the adjusting screws 21 and then moving the positioning means 20 relative to the first guide member 11 so as to cause the lower guide piece 17 to align with one selected line of the graduation lines 42, any selected distance from the lappet-formed side edge of the cloth 2 to the sewing area 5 may be determined. Thereafter, the adjusting screws are again tightened to set the determined distance.

Figure 4:
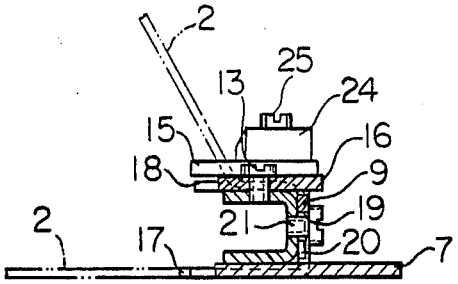
FIG. 4 is a section view taken substantially along the line IV — IV of FIG. 2 and as seen in the direction of the arrows thereof.

From the foregoing description of the general construction and arrangement of the cloth guide mechanism of the present invention, it will be understood that the novel cloth guide mechanism has advantages over the prior art guide mechanisms. For further understanding of the present invention, description will be now made in connection with the relative relation between the weight of the weight 41, the position of the cloth pinching members 39 on the guide rod 22 and the slanted side edge portion 15 of the second guide member 16. Prior to feeding of the cloth 2 to the sewing machine, the cloth 2 is folded at one side edge to form a lappet 43 and a fold 44. Thereafter, one end of the cloth having the lappet 43 and fold 44 is pinched between the pair of pinching members 39 at the nip 38, and the other end or leading end of the cloth 2 is inserted into the upper clearance 14 from the left side of the first guide member 11 (as seen in FIG. 2) and passes through the clearance 14, along the back of the first guide member intermediate web 9 and through the lower clearance 10 to the sewing area 5 on the needle plate 6 where a cycle of a sewing operation is initiated on the folded cloth side at a predetermined distance from the fold 44 as determined by the positioning means 20, with fold 44 maintained in contact with the adjacent side edges of the lower and upper guide pieces 17 and 18 of the cloth positioning means 20 which has been adjusted to be in alignment with one selected graduation line 42 on the needle plate 6. As the sewing operation progresses, the leading end of the cloth 2 being sewn is pulled in the direction of arrow A with the fold 44 maintained in slide contact with the lower and upper guide pieces 17 and 18 while the one end of the cloth 2 which is pinched between the pair of pinching members 39 at the nip 38 and pulled upwardly by the weight 41, which is connected to the pinching member assembly 39 by means of the string 40 as mentioned above, is also pulled and passed around the guide rod 22 at the same rate at which the folded side edge is pulled. For this purpose, the magnitude of the clamping force provided by the nip 38 is so selected that the nip will hold the one end of the cloth 2 in position, but at the same time allow the cloth edge to advance in the pulling direction A at the same rate at which the folded side edge is advanced as the leading end of the cloth 2 is pulled in such a direction. Immediately before the leading end of cloth 2 being pulled enters the upper clearance 14, the cloth contacts and moves along the slanted side edge portion 15 of the second guide member 16 as more clearly shown in FIGS. 2 and 4. The cloth portion is thereafter pulled through the upper clearance 14, along the back of the first guide member intermediate web 9 and through the lower clearance 10 to th sewing area 5 on the needle plate 6 while maintaining the fold 44 in slidable contact with the adjacent side edges of the upper and lower guide pieces 18 and 17 of the positioning means 20. For this purpose, the relation between the tension of the cloth imparted on the cloth 2 by the weight 41 through the string 40 and cloth pinching members 39 or the weight of the weight 41, the height to which the cloth 2 is pulled by the weight 41 or the height of the cloth pinching members 39 on the guide rod 22, and the position of the slanted side edge portion 15 of the second guide member 16 relative to a line normal to the cloth pulling direction A should be carefully determined for the following reasons. If the angle of the slanted side edge portion 15 of the second guide member 16 relative to a line normal to the cloth pulling direction A is a large as almost 90° and the nip 38 of the cloth pinching members 39 is positioned at an excessively high point on the guide rod 22 or far away from the sewing area 5 due to an excessively heavy weight of the weight 41, as the cloth 2 enters and is passed through the upper clearance 14 under the pulling force provided by the weight 41 the cloth 2 is subjected to a force which has the tendency to cause the fold 44 in the cloth to displace away from the adjacent side edge of the upper guide piece 18 of the positioning means 20. If such a force is greater than the force, which pulls the cloth to cause such material to pass through the upper clearance 14, along the back of the first guide member intermediate web 9 and through the lower clearance 10 to the sewing area 5 while maintaining the fold 44 in sliding contact with the adjacent side edges of the upper and lower guide pieces 18 and 17 under normal conditions, the cloth 2 will be fed to the sewing area 5 with the fold 44 spaced from the upper and lower guide pieces 18 and 17. Therefore, the distance of the fold 44 from the sewing area 5 or the distance of the fold 44 from a seam to be sewn therein will be inevitably unstable. On the contrary, if the angle of the slanted side edge portion 15 of the second guide member 16 relative to a line normal to the cloth pulling or guiding direction A is as small as about 0° or a negative value, the nip 38 of the cloth pinching members 39 will be positioned at an excessively low point on the guide rod 22, to the sewing area 5 assuming that the weight of the weight 41 is too light for pulling the cloth to a desired height, in addition to the force, which pulls the cloth toward the adjacent side edges of the upper and lower guide pieces 18 and 17 of the cloth positioning means 20 as the cloth passes along the slanted side edge portion 15, through the upper clearance 14, along the back of the first guide member intermediate web 9 and through the lower clearance 10 to the sewing area 5, the cloth is subjected to another force, which strongly urges the fold 44 of the cloth 2 to abut against the adjacent side edges of the upper and lower guide pieces 18 and 17 of the positioning means 20. This may cause the configuration of the fold 44 to become out of shape, and such out-of-shape fold 44 may overlap over a portion of the cloth adjacent to the fold as the cloth is being passed through the guide system, thereby resulting in clogging of the guide system. In order to eliminate the above-mentioned difficulty, according to the present invention, the mutual relation between the angle of the slanted side edge 15 of the second guide member 16 with respect to a line normal to the cloth pulling direction A, the position of the nip 38 of the cloth pinching members 39 on the guide rod 22 and the weight of the weight 41 is so selected that as the cloth is pulled through the guide system, the force, which urges the fold 44 of the cloth 2 away from the upper and lower guide pieces 18 and 17 of the positioning means 20, can be counterbalanced by the force which, urges the cloth fold 44 toward the upper and lower positioning means guide pieces 18 and 17, or the magnitude of the latter force may be in excess of that of the former force by a slight degree, whereby the cloth 2 may be always guided in a proper manner through the guide system while maintaining the fold 44 in sliding contact with the adjacent side edges of the upper and lower guide pieces 18 and 17.

In operation, the one end of cloth 2 to be sewn is pinched at the nip 38 of the pair of pinching members 39, which nip is positioned on the guide rod 22 at a suitable point on the rod as selected in accordance with the width of the cloth and the position of a seam line desired to be formed in the cloth, and the cloth positioning means 20 is adjusted so as to have the lower guide piece 17 align with one selected graduation line of the plural parallel and spaced lines 42, which one line is also selected in accordance with the cloth width and the desired seam position in the cloth. Thereafter, the leading end of the cloth 2 is pulled in a suitable manner along the slanted side edge portion 15 of the guide member 16, through the upper clearance 14, along the back of the first guide member intermediate web 9 and through the lower clearance 10 to the a sewing area 5 where a cycle of sewing operation is effected. As the cloth 2 is pulled through the guide system in the manner as mentioned above, it will be understood that the side edge of the cloth, where the lappet 43 and fold 44 has been formed, is maintained in sliding contact with the adjacent side edges of the upper and lower guide pieces 18 and 17 of the positioning means 20, whereby a desired seam line may be evenly formed in the cloth at a predetermined distance from the fold 44 thereof. It will also be understood that as the cloth 2 enters the upper clearance 14 in the manner as mentioned above the lappet 43 is flexed to overlap over the area which lies underneath the flexed lappet. Such an overlapping relation can be maintained all the way as the cloth is pulled through the guide system and then sewn at the sewing area 5 on the needle plate 6. Furthermore, as the cloth 2 is pulled through the guide system and sewn in the manner as mentioned above, the cloth pinching member assembly 39 gradually moves downwardly along the rod 22 while gradually pulling the weight 41 upwardly through the string 40, one end of which is anchored to the pinching member assembly. Such overlapping of the lappet 43 over the underlying cloth area and downward movement of the pinching member assembly 39 assures the formation of a seam line in the cloth 2 at a uniform distance from the fold 44. When it is necessary or desired to adjust or vary the distance of the seam line formation position from the fold 44, the screws 21, which secure the positioning means 20 to the back of the first guide member intermediate web on 9, are loosened and the positioning means is moved relative to the first guide member 11 to a desired position along the back of the guide member intermediate web 9 until the lower guide piece 17 aligns with one selected line of graduation lines 42 on the needle plate 6. Thereafter, the screws 21 are again tightened to set the positioning means 20 in the adjusted position. In this way, the distance of the seam line from the fold 44 can be easily adjusted or varied.

As mentioned above, according to the present invention, as the cloth 2 is pulled through the upper clearance 14, along the back of the first guide member intermediate web 9 and through the lower clearance 10 to the sewing area 5 the cloth is subjected to the force which urges the fold 44 thereof to abut against the upper and lower guide pieces 18 and 17 of the positioning means 20. However, the magnitude of such a force can be reduced by the force which tensions the cloth so that the second guide member 16 on the first guide member 11 and the means which tensions the cloth cause the material to be sewn to contact the slanted side edge portion 15 of the second guide member 16, whereby the cloth 2 will always maintain a suitable sliding contact relation on its fold-formed side with the adjacent sides of the upper and lower positioning means guide pieces 18 and 17 with a suitable moderate force and the folded cloth side can be effectively prevented from being creased due to its abutting against the guide pieces with a strong force. Thus, a high quality of sewn cloth having a seam line at a uniform distance from its folded side edge can be obtained and there will be no disadvantage such as clogging-up of the guide system which may otherwise occur when the cloth is pulled or guided through the system if the folded side edge of the cloth is forced against the parts of the system with which the fold 44 contacts with a strong force. Furthermore, the novel cloth guide mechanism has advantages that the mechanism has a very simple and compact construction and is easy and reliable in operation.

It will be understood that various modifications and variations to the embodiment of the invention as illustrated and described herein may be resorted to without departing from the scope of the concept of the present invention. Therefore, the scope of the ivention should be limited only by the scope and proper interpretation of the claims appended hereto.

We claim:

1. A sewing machine cloth guide mechanism of the type wherein a cloth is fed downwardly and in a first direction away from a sewing area of the sewing machine from a position above the sewing machine, the cloth is folded along one side edge thereof, and the cloth is then fed in a second direction over a needle plate of said sewing machine and through the sewing area while a seam is sewed in the cloth in a direction parallel to said second direction and parallel to the folded side edge, said cloth guide mechanism comprising:

a first guide member extending over the needle plate with a first clearance therebetween;

a second guide member positioned above said first guide member with a second clearance therebetween;

said cloth passing through said second clearance when being fed in said first direction, and then passing through said first clearance when being fed in said second direction;

a cloth positioning member attached to said first guide member and including upper and lower guide pieces, said lower guide piece extending through said first clearance, and said upper guide piece extending through said second clearance, said upper and lower guide pieces comprising means for guiding the folded side edge of said cloth while said cloth is fed in said first and second directions, respectively;

said second guide member having an edge inclined to a line normal to said second direction;

a guide rod extending upwardly from said second guide member;

gripping means, slidably mounted on said guide rod, for resiliently gripping said cloth as it is led from the position above the sewing mechine in said first direction;

the feeding of said cloth in said second direction exerting a first force tending to urge said folded side edge of said cloth against said upper and lower guide pieces; and means, connected to said gripping means, for urging said gripping means upwardly along said guide rod and for thereby exerting a second force opposing said first force on said cloth.

2. A mechanism as claimed in claim 1, wherein said cloth positioning member is adjustable in a direction transverse to said second direction.

3. A mechanism as claimed in claim 2, wherein said cloth positioning member comprises a plate having a longitudinal slot therein, fastening means extending through said slot and attaching said plate to said first guide member, and said upper and lower guide pieces respectively comprising upper and lower legs extending from said plate, said upper leg extending at an angle to said second direction, and said lower leg extending parallel to said second direction.

4. A mechanism as claimed in claim 3, further comprising a plurality of parallel and spaced lines provided on the needle plate and extending parallel to said second direction, said lower leg being adjustably alignable with a selected of said lines.

5. A mechanism as claimed in claim 1, wherein said urging means comprises a weight connected to said gripping means for urging said gripping means upwardly.

6. A mechanism as claimed in claim 5, further comprising a vertically extending hollow pillar, said weight being positioned within said pillar, and a line connected at a first end thereof to said weight and extending upwardly therefrom, said line being connected at a second end thereof to said gripping means.

7. A mechanism as claimed in claim 1, wherein said gripping means comprises a pair of pivotally connected pinching members, and means for urging first ends of said pinching members apart and second ends of said pinching members together, said second ends of said pinching members thereby forming a nip resiliently gripping said cloth.

8. A mechanism as claimed in claim 1, wherein said first and second guide members extend across the needle bed at an angle to a line normal to said second direction.

* * * * *